United States Patent [19]

Kanda et al.

[11] Patent Number: 5,017,545

[45] Date of Patent: May 21, 1991

[54] HEAT SENSITIVE RECORDING MATERIAL

[75] Inventors: Nobuo Kanda, Neyagawa; Ritsuo Mandoh, Sakai; Masaharu Nojima, Amagasaki; Naoto Arai, Ikeda, all of Japan

[73] Assignee: Kanzaki Paper Manufacturing Company, Limited, Tokyo, Japan

[21] Appl. No.: 359,899

[22] Filed: Jun. 1, 1989

[30] Foreign Application Priority Data

Jun. 8, 1988 [JP] Japan ..... 63-142097

[51] Int. Cl.[5] ..... B41M 5/18

[52] U.S. Cl. ..... 503/208; 503/207; 503/209; 503/214; 503/225

[58] Field of Search ..... 427/150–152; 503/208, 209, 225, 207, 214

[56] References Cited

U.S. PATENT DOCUMENTS 4,531,140 7/1985 Suzuki et al. ..... 346/209

4,794,102 12/1988 Petersen et al. ..... 503/209

FOREIGN PATENT DOCUMENTS 2165953A 4/1985 United Kingdom .

*Primary Examiner*—Bruce H. Hess

*Attorney, Agent, or Firm*—Armstrong, Nikaido, Marmelstein, Kubovcik & Murray

[57] ABSTRACT

A heat sensitive recording material comprising a substrate and a heat sensitive recording layer thereon incorporating a colorless or light-colored basic dye and a color acceptor reactive with the dye to form a color when contacted therewith, the recording material being characterized in that the material has a heat sensitive recording layer having incorporated therein (1) a heat-fusible substance exhibiting a weight reduction of at least 5% at 200° C. based on the weight at 25° C. under the condition of 20° C./min in the rate of rise of temperature, (2) a wax, (3) a lubricant, and (4) an oil-absorbing pigment at least 85 ml/100 g in oil absorption.

4 Claims, No Drawings

HEAT SENSITIVE RECORDING MATERIAL

The present invention relates to heat sensitive recording materials, and more particularly to a heat sensitive recording material having a high sensitivity and less likely to permit adhesion of tailings to the thermal head.

Heat sensitive recording materials are well known which are adapted to produce color images by thermally contacting a colorless or light-colored basic dye with a color acceptor for a color forming reaction.

Communication recording devices, such as facsimile systems, for use with heat sensitive recording materials have been rapidly introduced into wide use in recent years because of their convenience, and made operable at a higher speed. Accordingly, various proposals have been made to provide heat sensitive recording materials having an enhanced sensitivity as required. As a preferred method of giving enhanced sensitivities, it is known to incorporate into the recording layer a heat-fusible substance which is highly compatible and readily miscible with the basic dye and color acceptor on melting in a suitable temperature range. Nevertheless, it has been found that such heat-fusible substances which are effective for giving enhanced sensitivities develop the trouble that when the thermal head is used continuously for printing, the substance permits adhesion of tailings to the head in a gradually increasing amount, allowing the tailings to deface the recording layer. Thus, it is strongly desired to develop recording layers of enhanced sensitivity free of such drawback.

In view of the foregoing situation, we have conducted extensive research to obviate the above drawback and consequently found that the thermal head, which is heated to a high temperature of at least 200° C. under the printing condition, causes a certain type of heat-fusible substance to vaporize and become deposited on a low-temperature portion of the thermal head in the form of tailings. To quantitatively determine the heat-fusible substance which is responsible to the adhesion of tailings, we conducted repeated tests under varying conditions with use of TG-DSC, product of Rigaku Denki Co., Ltd., and established that the adhesion of tailings to the thermal head occurs during continuous printing when the heat-fusible substance exhibits a weight reduction of at least 5% at 200° C. based on the weight at 25° C. under the condition of 20° C./min in the rate of rise of temperature.

Based on this finding, we have further conducted intensive research to remedy the adhesion of tailings due to the use of the heat-fusible substance which exhibits the specific weight reduction.

An object of the invention is to provide a heat sensitive recording material in which the adhesion of tailings to the head can be effectively diminished while permitting the heat-fusible substance to retain its excellent sensitivity enhancing effect.

The above and other objects of the invention will become apparent from the following description.

The present invention provides a heat sensitive recording material comprising a substrate and a heat sensitive recording layer thereon incorporating a colorless or light-colored basic dye and a color acceptor reactive with the dye to form a color when contacted therewith, the recording material being characterized in that the material has a heat sensitive recording layer having incorporated therein (1) a heat-fusible substance exhibiting a weight reduction of at least 5% at 200° C. based on the weight at 25° C. under the condition of 20° C./min in the rate of rise of temperature, (2) a wax, (3) a lubricant, and (4) an oil-absorbing pigment at least 85 ml/100 g in oil absorption. The above weight reduction can be measured by a thermogravimetric analysis (TG analysis).

Examples of heat-fusible substances exhibiting a weight reduction of at least 5% at 200° C. based on the weight at 25° C. under the condition of 20° C./min in the rate of rise of temperature for use in the heat sensitive recording layer of the invention are 1,2-diphenoxyethane, dimethyl terephthalate, 2-(2'-hydroxy-5'-methylphenyl)benzotriazole, 2,4,6-tri-tert-butylphenol, 1,4-diethoxynaphthalene, 1,4-dimethoxynaphthalene, 2-(N,N-dimethylamino)indane-1,3-dione and the like. Among these, 1,2-diphenoxyethane has a high sensitivity enhancing effect and is therefore especially preferable to use. When required, at least two of these heat-fusible substances are used in admixture.

Examples of waxes for use in the recording layer are beeswax, shellac wax and like animal waxes, carnauba wax and like vegetable waxes, paraffin wax, microcrystalline wax and like petroleum waxes, polyethylene wax, polyhydric alcohol esters of higher fatty acids, higher ketones, higher amines, higher amides, condensation products of higher fatty acids and amines, synthetic paraffin, chlorinated paraffin and like synthetic waxes. Such waxes are used in the form of finely divided particles or emulsions. Among these waxes, those less miscible with the basic dye, the color acceptor and the heat-fusible substance are more effective for diminishing the adhesion of tailings. Paraffin wax is less miscible with the basic dye and the like and less likely to reduce the sensitivity, is therefore especially preferable, and is most preferable when having a melting point of 45° to 80° C.

When having a melting point of below 45° C., paraffin wax has increased tackiness and is less effective for remedying the adhesion of tailings. If the melting point exceeds 80° C., the images produced tend to have a lower color density.

Examples of lubricants for use in the recording layer of the heat sensitive recording material of the invention are fine powders or emulsions of polyvalent metal salts of higher fatty acids, such as zinc stearate, calcium stearate, aluminum stearate and zinc oleate. Among these lubricants, zinc stearate is outstanding in the effect contemplated by the invention and is therefore especially desirable to use.

The thermal vaporization of the heat-fusible substance and the resulting adhesion of tailings to the thermal head can be considerably diminished by the conjoint presence of the heat-fusible substance, the wax and the lubricant in the recording layer, whereas the recording layer still remains to be improved to completely obviate the adhesion of tailings to the head that occurs presumably due to an increase in the overall proportion of meltable component of the recording layer. With the heat sensitive recording material of the present invention, therefore, an oil-absorbing pigment at least 85 ml/100 g in oil absorption is further incorporated into the recording layer. The oil absorption is measured according to J I S (Japan Industrial Standard) K 5101.

If pigments are used which are less than 85 ml/100 g in oil absorption, it is difficult to remedy the adhesion of tailings while ensuring a high recording sensitivity, so that the pigment selected for use in the invention should be at least 85 ml/100 g, preferably at least 100 ml/100 g and up to 400 ml/100 g, in oil absorption. When more than 400 ml/100 g, the sensitivity is likely to decrease and therefore a pigment is preferable to use which has up to 400 ml/100 g in oil absorption.

Given below are examples of useful pigments, each with its oil absorption, which is not less than 85 ml/100 g, given in parentheses as expressed in ml/100 g. Diatomaceous earth (110~120), calcined diatomaceous earth (130~140), flux-calcined diatomaceous earth (120~160), finely divided anhydrous aluminum oxide (85~250), finely divided titanium oxide (85~120), magnesium carbonate (85~150), white carbon (85~300), finely divided anhydrous silica (100~300), magnesium aluminosilicate (300~400), agglomerates of finely divided precipitated calcium carbonate (85~100), calcined clay (90~110) and the like.

Although the oil absorption varies with the shape and diameter of pigment particles, also effectively usable are pigments which are physically or chemically so treated as to exhibit an oil absorption in the specified range.

As a colorless or light-colored basic dye contained in the heat sensitive recording layer in the present invention are known various basic dyes. Examples thereof are:

Triarylmethane-based dyes, e.g., 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide, etc.

Diphenylmethane-based dyes, e.g., 4,4'-bisdimethylaminobenzhydryl benzyl ether, N-halophenylleucoauramine, N-2,4,5-trichlorophenyl-leucoauramine, etc.

Thiazine-based dyes, e.g., benzoylleucomethyleneblue, p-nitrobenzoyl-leucomethyleneblue, etc.

Spiro-based dyes, e.g., 3-methyl-spiro-dinaphthopyran, 3-ethyl-spirodinaphthopyran, 3-phenylspirodinaphthopyran, 3-benzyl-spiro-dinaphthopyran, 3-methyl-naphtho-(6'-methoxybenzo)spiropyran, 3-propyl-spirodisbenzopyran, etc.

Lactam-based dyes, e.g., rhodamine-B-anilinolactam, rhodamine-(p-nitroanilino)lactam, rhodamine(o-chloroanilino)lactam, etc.

Fluoran-based dyes, e.g., 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N-methyl-N-benzylaminofluoran, 3-diethylamino-7-N-chloroethyl-N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7-phenylaminofluoran, 3-dibutylamino-6-methyl-7-phenylaminofluoran, 3-diethylamino-7-(2-carbomethoxyphenylamino)fluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-(N-methyl-N-n-amyl-)amino-6-methyl-7-phenylaminofluoran, 3-(N-ethyl-N-n-amyl)amino-6-methyl-7-phenylaminofluoran, 3-(n-ethyl-isoamyl)amino-6-methyl-7-phenylaminofluoran, 3-(N-methyl-N-n-hexyl)amino-6-methyl-7-phenylaminofluoran, 3-(N-ethyl-N-n-hexyl)amino-6-methyl-7-phenylaminofluoran, 3-(N-ethyl-N-$\beta$-ethylhexyl)amino-6-methyl-7-phenylaminofluoran, 3-(N-ethyl-N-tetrahydrofurfuryl)amino-6-methyl-7-phenylaminofluoran, 3-(N-ethyl-N-cyclopentyl)amino-6-methyl-7-phenylaminofluoran, etc. These basic dyes are not limited thereabove and can be used, as required, in a mixture of at least two of them.

As a color acceptor are used various compounds which form color in contact with the basic dyes. Examples thereof are 4-tert-butylphenol, $\alpha$-naphthol, $\beta$-naphthol, 4-acetylphenol, 4-tert-octylphenol, 4,4'-sec-butylidenediphenol, 4-phenylphenol, 4,4'-dihydroxydiphenyl-methane, 4,4'-isopropylidenediphenol, hydroquinone, 4,4'-cyclohexylidenediphenol, 4,4'-(1,3-dimethylbutylidene)bisphenol, 4,4'-dihydroxydiphenylsulfide, 4,4'-thiobis(6-tert-butyl-3-methylphenol), 4,4'-dihydroxydiphenylsulfone, 4-hydroxy-4'-methyldiphenylsulfone, 4-hydroxy-4'-methoxydiphenylsulfone, 4-hydroxy-4'-isopropoxydiphenylsulfone, 4-hydroxy-3',4'-trimethylenediphenylsulfone, 4-hydroxy-3',4'-tetramethylene-diphenylsulfone, 3,4-dihydroxy-4'-methyldiphenylsulfone, bis(3-allyl-4-hydroxyphenyl)sulfone, 1,3-di[2-(4-hydroxyphenyl)-2-propyl]benzene, 1-[$\alpha$-methyl-$\alpha$-(4'-hydroxyphenyl)ethyl]-4-[$\alpha'$,$\alpha'$-bis(4'-hydroxyphenyl)ethyl]benzene, hydroquinone monobenzyl ether, butyl bis(4-hydroxyphenyl)acetate, 4-hydroxybenzophenone, 2,4-dihydroxybenzophenone, 2,4,4'-trihydroxybenzophenone, 2,2',4,4'-tetrahydroxybenzophenone, dimethyl 4-hydroxyphthalate, methyl 4-hydroxybenzoate, ethyl 4-hydroxybenzoate, propyl 4-hydroxybenzoate, sec-butyl 4-hydroxybenzoate, pentyl 4-hydroxybenzoate, phenyl 4-hydroxybenzoate, benzyl 4-hydroxybenzoate, tolyl 4-hydroxybenzoate, chlorophenyl 4-hydroxybenzoate, phenylpropyl 4-hydroxybenzoate, phenethyl 4-hydroxybenzoate, p-chlorobenzyl 4-hydroxybenzoate, p-methoxybenzyl 4-hydroxybenzoate, novolak phenol resin, phenolic polymer and like phenolic compounds; benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-($\alpha$-methylbenzyl)salicylic 3-benzylsalicylic acid, 3-($\alpha$-methylbenzyl)salicylic acid, 3-chloro-5-($\alpha$-methylbenzyl)salicylic acid, 3-phenyl-5-($\alpha$,$\alpha$-dimethylbenzyl)salicylic acid, 3,5-di-$\alpha$-methylbenzylsalicylic acid and like aromatic carboxylic acids; also, salts of such phenolic compounds or aromatic carboxylic acids with zinc, magnesium, aluminum, calcium, titanium, manganese, tin, nickel and like polyvalent metals, etc. The above color acceptor can be used, as required, in a mixture of at least two of them.

With the heat sensitive recording materials of the invention, the proportions of basic dye and color acceptor are not particularly limited but can be determined suitably according to the kinds of basic dye and color acceptor. For example, usually 100 to 700 parts by weight, preferably 150 to 400 parts by weight, of the color acceptor is used per 100 parts by weight of the basic dye.

In the present heat sensitive recording material, the amount of the above heat-fusible substance is not particularly limited but is usually 50 to 500 parts by weight, preferably 100 to 300 parts by weight per 100 parts by weight of the basic dye.

The amount of waxes depends on the kind of the material conjointly used and is usually 3 to 100 parts by weight, preferably 10 to 50 parts by weight per 100 parts by weight of the heat-fusible substance. With less than 3 parts by weight, the adhesion of tailings is not sufficiently prevented. When excess of 100 parts by weight is used, the recording sensitivity greatly decreases and prevention of the adhesion of tailings is not so effectively achieved.

The lubricant is incorporated into the recording layer usually in an amount of 10 to 100 parts by weight, preferably 30 to 60 parts by weight per 100 parts by weight of the heat-fusible substance. When the amount is less than 10 parts by weight, the adhesion of tailings is not sufficiently prevented and the sticking occurs on the thermal head. With more than 100 parts by weight, the recording sensitivity greatly decreases.

Further, the oil-absorbing pigment having a specific oil absorption which is conjointly added to the recording layer is used usually in an amount of 10 to 500 parts by weight, preferably 50 to 300 parts by weight per 100 parts by weight of the heat-fusible substance. With less 10 parts by weight, the adhesion of tailings is not sufficiently prevented. When excess of 500 parts by weight is used, the recording sensitivity greatly decreases.

For preparing a coating composition comprising the foregoing components, the basic dye and the color acceptor are dispersed, together or individually, into water serving as a dispersion medium, using stirring and pulverizing means such as a ball mill, attritor or sand mill.

Usually the coating composition has incorporated therein a binder in an amount of 2 to 40% by weight, preferably 5 to 25% by weight, based on the total solids content of the composition. Examples of useful binders are starches, hydroxyethyl cellulose, methyl cellulose, carboxymethyl cellulose, gelatin, casein, gum arabic, polyvinyl alcohol, styrene-maleic anhydride copolymer salt, styrene-acrylic acid copolymer salt, styrene-butadiene copolymer emulsion, etc.

Various other auxiliary agents can be further added to the coating composition. Examples of useful agents are dispersants such as sodium dioctylsulfosuccinate, sodium dodecylbenzenesulfonate, sodium salt of lauryl alcohol sulfuric acid ester, fatty acid metal salts, etc., defoaming agents, fluorescent dyes, coloring dyes, etc.

In addition, to the composition may be added in order to prevent the adhesion of tailings to the thermal head, inorganic pigment such as kaolin, clay, talc and calcium carbonate, which has oil absorption less than 85 ml/100 g.

Further, to the composition may be added in an amount which does not cause adverse effect, aliphatic fatty acid amide such as stearic acid amide, stearic acid methylenebisamide, oleic acid amide, palmitic acid amide, coconut fatty acid amide, etc; hindered phenols such as 2,2'-methylene-bis(4-methyl-6-tert-butylphenol), 4,4'-butylidenebis(6-tert-butyl-3-methylphenol), 1,1,2-tris(2-methyl-4-hydroxy-5-tert-butylphenyl)butane, etc; ethers such as p-benzylbiphenyl, 1,2-bis(3-methylphenoxy)ethane, 2-naphthol benzyl ether, etc; esters such as dibenzyl terephthalate, phenyl 1-hydroxy-2-naphthoate, etc; ultraviolet absorbers such as 2-(2'-hydroxy-5'-methylphenyl)benzotriazole, 2-hydroxy-4-benzyloxybenzophenone, etc; and various known heat-fusible substances as a sensitizer.

In the present heat sensitive recording material, the method of forming the recording layer is not particularly limited. For example, the coating composition is applied to a substrate by an air knife coater, blade coater, bar coater, gravure coater, curtain coater or like suitable means. The amount of coating composition, which is not limited particularly, is usually 2 to 12 g/m$^2$, preferably 3 to 10 g/m$^2$, based on dry weight. As a substrate (support) to be coated, may be used a paper, plastic film, synthetic fiber paper or the like, but a paper is preferably used.

Further, it is possible to form an over-coat layer on the recording layer to protect the layer. Various other known techniques in the field of heat sensitive recording material can be applied. For example, it is possible to form a protective layer on the rear surface of the support, to form a primary coating layer on the support, to form a tackifier layer on the rear surface of the support.

The invention will be described below in more detail with reference to Examples by no means limited to, in which parts and percentages are all by weight, unless otherwise specified.

EXAMPLE 1

① Composition (A)

| | |
|---|---|
| 3-(N-Ethyl-N-isoamyl)amino-6-methyl-7-phenylaminofluoran | 10 parts |
| 5% Aqueous solution of methyl cellulose | 5 parts |
| Water | 40 parts |

These components were pulverized by a sand mill to prepare Composition (A) having an average particle size of 2 μm.

② Composition (B)

| | |
|---|---|
| 4,4'-Isopropylidenediphenol | 20 parts |
| 5% Aqueous solution of methyl cellulose | 5 parts |
| Water | 55 parts |

These components were pulverized by a sand mill to prepare Composition (B) having an average particle size of 2 μm.

③ Composition (C)

| | |
|---|---|
| 1,2-Diphenoxyethane | 10 parts |
| 5% Aqueous solution of methyl cellulose | 5 parts |
| Water | 55 parts |

These components were pulverized by a sand mill to prepare Composition (C) having an average particle size of 2 μm.

④ Preparation of a recording layer

A coating composition for a heat sensitive recording layer was prepared by mixing with stirring 55 parts of Composition (A), 80 parts of Composition (B), 80 parts of Composition (C), 2.5 parts of paraffin wax emulsion (Hidorin #P-7, product of Chukyo Yushi Co., Ltd., 30% solid), 35 parts of zinc stearate emulsion (Hidorin

#Z-7-30, product of Chukyo Yushi Co., Ltd., 31.5% solid), 50 parts of finely divided anhydrous silica (oil absorption: 180 ml/100 g), 100 parts of 20% aqueous solution of oxidized starch and 130 parts of water. To a paper substrate weighing 50 g/m$^2$ was applied and dried the above coating composition in an amount of 8 g/m$^2$ by dry weight to obtain a heat sensitive recording paper.

EXAMPLES 2 to 4

Heat sensitive recording papers were prepared in the same manner as in Example 1 except that, in the preparation of the coating composition for a heat sensitive recording layer, the amount of paraffin wax emulsion is changed to 9 parts (Example 2), 30 parts (Example 3) or 60 parts (Example 4).

EXAMPLES 5 to 7

Heat sensitive recording papers were prepared in the same manner as in Example 3 except that, in the preparation of the coating composition for a heat sensitive recording layer, the amount of zinc stearate emulsion is changed to 7.6 parts (Example 5), 22 parts (Example 6) or 57 parts (Example 7).

EXAMPLES 8 to 10

Heat sensitive recording papers were prepared in the same manner as in Example 3 except that, in the preparation of the coating composition for a heat sensitive recording layer, the amount of finely divided anhydrous silica is changed to 3 parts (Example 8), 14 parts (Example 9) or 96 parts (Example 10).

EXAMPLES 11 and 12

Heat sensitive recording papers were prepared in the same manner as in Example 3 except that, in the preparation of Composition (C), dimethyl terephthalate (Example 11) or 1,4-diethoxynaphthalene (Example 12) is used in place of 1,2-diphenoxyethane.

EXAMPLE 13

A heat sensitive recording paper was prepared in the same manner as in Example 3 except that, in the preparation of the coating composition for a heat sensitive recording layer, 45 parts of polyethylene wax emulsion [LB Coat LB-PE, Kindai Chemical Industry Co., Ltd., 40% solids] was used in place of 30 parts of paraffin wax emulsion.

EXAMPLE 14

A heat sensitive recording paper was prepared in the same manner as in Example 3 except that, in the preparation of the coating composition for a heat sensitive recording layer, 35 parts of calcium stearate emulsion [LB Coat LB-131(50), Kindai Chemical Industry Co., Ltd., 50% solids] was used in place of 35 parts of zinc stearate emulsion.

EXAMPLE 15

A heat sensitive recording paper was prepared in the same manner as in Example 3 except that, in the preparation of the coating composition for a heat sensitive recording layer, 70 parts of agglomerates of finely divided precipitated calcium carbonate (90 ml/100 g in oil absorption) was used in place of 50 parts of finely divided anhydrous silica (180 ml/100 g in oil absorption).

COMPARISON EXAMPLES 1 AND 2

Heat sensitive recording papers were prepared in the same manner as in Example 1 except that, in the preparation of the coating composition for a heat sensitive recording layer, the amount of paraffin wax emulsion is changed to 1.7 parts (Comparison Example 1) or 70 parts (Comparison Example 2).

COMPARISON EXAMPLES 3 AND 4

Heat sensitive recording papers were prepared in the same manner as in Example 3 except that, in the preparation of the coating composition for a heat sensitive recording layer, the amount of zinc stearate emulsion is changed to 0 part (Comparison Example 3) or 76 parts (Comparison Example 4).

COMPARISON EXAMPLES 5 AND 6

Heat sensitive recording papers were prepared in the same manner as in Example 3 except that, in the preparation of the coating composition for a heat sensitive recording layer, the amount of finely divided anhydrous silica is changed to 1.6 parts (Comparison Example 5) or 110 parts (Comparison Example 6).

COMPARISON EXAMPLE 7

A heat sensitive recording paper was prepared in the same manner as in Example 3 except that, in the preparation of the coating composition for a heat sensitive recording layer, 96 parts of precipitated calcium carbonate (50 ml/100 g in oil absorption) was used in place of 50 parts of finely divided anhydrous silica (180 ml/100 g in oil absorption).

The 22 kinds of heat sensitive recording papers thus obtained were used for recording on a thermal facsimile device (PANAFAX UF-60, product of Matsushita Denso Co., Ltd.). The color density ($D_1$) of the images recorded was measured by a Macbeth reflective densitometer (Model RD-914, product of Macbeth Corp.). Table 1 shows the result.

Further 3 rolls (each 100 m in length) of each heat sensitive recording paper were continuously used for printing on the facsimile device, and the thermal head was thereafter checked for the adhesion of tailings, with the result listed in Table 1. The paper was also used for printing a 100% solid black image and checked for sticking to the thermal head. Table 1 also shows the result.

The check results were evaluated according to the following criteria.

Adhesion of tailings

○ : Almost no adhesion of tailings

Δ: Slight adhesion of tailings but the paper is usable without any printing trouble ×: Marked adhesion of tailings, leading to printing trouble.

Sticking

○: No trace of sticking on recorded images

Δ: Some traces of sticking on recorded images but the paper is usable free of problem ×: Manifest traces of sticking on recorded images, making the paper unusable.

TABLE 1

| | Color density | Adhesion of tailings | Sticking |
|---|---|---|---|
| Ex. 1 | 1.18 | Δ | O |
| Ex. 2 | 1.17 | O | O |
| Ex. 3 | 1.13 | O | O |
| Ex. 4 | 1.09 | Δ | O |
| Ex. 5 | 1.16 | Δ | Δ |
| Ex. 6 | 1.15 | O | O |
| Ex. 7 | 1.07 | Δ | O |
| Ex. 8 | 1.12 | Δ | O |
| Ex. 9 | 1.16 | O | O |
| Ex. 10 | 1.02 | O | O |
| Ex. 11 | 1.07 | O | O |
| Ex. 12 | 1.06 | O | O |
| Ex. 13 | 1.12 | Δ | Δ |
| Ex. 14 | 1.13 | Δ | Δ |
| Ex. 15 | 1.14 | Δ | O |
| Com. Ex. 1 | 1.18 | X | O |
| Com. Ex. 2 | 0.84 | X | O |
| Com. Ex. 3 | 1.09 | X | X |
| Com. Ex. 4 | 0.92 | X | O |
| Com. Ex. 5 | 1.10 | X | Δ |
| Com. Ex. 6 | 0.80 | O | O |
| Com. Ex. 7 | 0.87 | X | X |

As apparent from Table 1, the heat sensitive recording materials obtained in the present examples are excellent in high-speed recording and are free from the adhesion of tailings and sticking.

We claim:

1. A heat sensitive recording material comprising a substrate and a heat sensitive recording layer provided on the substrate, wherein the heat sensitive recording layer contains a colorless or light-colored basic dye and a color acceptor which is reactive with the dye to form a color when contacted with the dye, said heat sensitive recording layer further containing:

(1) a heat-fusible substance which is 1,2-diphenoxyethane said heat-fusible substance exhibiting a weight reduction of at least 5% at 200° C. based on the weight at 25° C. under the condition of a rate of temperature increase of 20° C./minute;

(2) 10–50 parts by weight of a wax per 100 parts by weight of the heat-fusible substance;

(3) 30–60 parts by weight of a lubricant per 100 parts by weight of the heat-fusible substance; and (4) 50–300 parts by weight of an oil-absorbing pigment per 100 parts of the heat-fusible substance, said oil-absorbing pigment having an oil absorption of at least 85 ml/100 g.

2. A heat sensitive recording material as defined in claim 1 wherein the wax is a paraffin wax having a melting point of 45° to 80° C.

3. A heat sensitive recording material as defined in claim 1 wherein the lubricant is zinc stearate.

4. A heat sensitive recording material as defined in claim 1 wherein the pigment has an oil absorption of 84 ml/100 g to 400 ml/100 g.

* * * * *